US008991376B2

(12) United States Patent
McPherson

(10) Patent No.: US 8,991,376 B2
(45) Date of Patent: Mar. 31, 2015

(54) ARCHERY BOW AXLE CONNECTOR

(71) Applicant: Mathew A. McPherson, Sparta, WI (US)

(72) Inventor: Mathew A. McPherson, Sparta, WI (US)

(73) Assignee: MCP IP, LLC, Sparta, WI (US)

( * ) Notice: Subject to any disclaimer, the term of this patent is extended or adjusted under 35 U.S.C. 154(b) by 102 days.

(21) Appl. No.: 13/756,300

(22) Filed: Jan. 31, 2013

(65) Prior Publication Data

US 2014/0209080 A1 Jul. 31, 2014

(51) Int. Cl.
*F41B 7/00* (2006.01)
*F41B 5/10* (2006.01)

(52) U.S. Cl.
CPC ..... *F41B 5/10* (2013.01)
USPC ..... 124/25.6; 124/23.1; 124/86; 124/1

(58) Field of Classification Search
USPC ..... 124/1, 23.1, 25.6, 86
See application file for complete search history.

(56) References Cited

U.S. PATENT DOCUMENTS

| | | | | |
|---|---|---|---|---|
| D42,639 | S | 6/1912 | Marshall | |
| 4,258,464 | A | 3/1981 | Ullman, Jr. | |
| 4,546,754 | A | 10/1985 | Smith | |
| 4,605,335 | A | 8/1986 | Otrusina | |
| 4,781,167 | A | 11/1988 | Martin | |
| 4,926,833 | A * | 5/1990 | Darlington | 124/23.1 |
| 4,967,721 | A | 11/1990 | Larson | |
| 5,031,599 | A * | 7/1991 | Cruise | 124/23.1 |
| 5,146,908 | A | 9/1992 | Larson | |
| 5,362,282 | A | 11/1994 | Lickton | |
| 5,606,963 | A | 3/1997 | Wenzel et al. | |
| D386,141 | S | 11/1997 | Pingel et al. | |
| 5,697,355 | A | 12/1997 | Schaffer | |
| 6,035,840 | A | 3/2000 | McPherson | |
| 6,360,735 | B1 | 3/2002 | Larson et al. | |
| 6,443,139 | B1 | 9/2002 | McPherson | |
| 6,474,324 | B1 | 11/2002 | Despart et al. | |
| 6,966,312 | B1 | 11/2005 | Larson | |
| 8,037,876 | B1 | 10/2011 | Yehle | |
| 8,056,548 | B1 | 11/2011 | Larson | |
| 8,069,848 | B1 | 12/2011 | Larson | |
| D664,231 | S | 7/2012 | McPherson | |
| D665,867 | S | 8/2012 | McPherson | |
| 8,683,989 | B1 * | 4/2014 | McPherson | 124/25.6 |
| 2006/0011190 | A1 * | 1/2006 | Andrews | 124/89 |
| 2008/0127956 | A1 | 6/2008 | Bednar et al. | |
| 2010/0154769 | A1 | 6/2010 | Grace, Jr. | |
| 2010/0263650 | A1 | 10/2010 | Dahl, II et al. | |
| 2010/0307471 | A1 * | 12/2010 | McPherson | 124/25.6 |

OTHER PUBLICATIONS

DuPont Engineering Polymers, "Delrin® acetal resin® The low wear/low friction resin guide for Delring®", www.dupont.com/eng-gpolymers, Printed Jan. 31, 2013.

* cited by examiner

*Primary Examiner* — Gene Kim
*Assistant Examiner* — John E Simms, Jr.
(74) *Attorney, Agent, or Firm* — Vidas, Arrett & Steinkraus

(57) ABSTRACT

In some embodiments, a connector attaches to an axle of an archery bow and comprises a cable terminal. The connector comprises a first body portion made from a first material and a second body portion made from a second material different from the first material. The first body portion defines an aperture therethrough arranged to engage the axle. The second body portion has a groove extending around at least a portion of its periphery, forming a teardrop shape. In some embodiments, the connector is configured to snap-fit onto an axle and be removable without tools.

20 Claims, 6 Drawing Sheets

ARCHERY BOW AXLE CONNECTOR

BACKGROUND OF THE INVENTION

This invention relates generally to archery bows and more specifically to an axle connector for use with archery bows.

Archery bows having "split limbs" are generally known in the art. Such bows typically include an axle extending between two split-limb portions. The axle can support a cam, pulley, etc. Clips attached to the ends of the axle secure the axle in place with respect to the limb.

Prior art axle clips often require tools for installation or removal. For example, a spring tension clip having an E-configuration can engage the axle. So called E-clips generally require a tool for installation and removal, such as pliers. Some alternative axle clips are capable of being installed without tools, but require a tool such as a flathead screwdriver for removal.

U.S. Patent Application Publication No. 2010/0307471 teaches an axle connector configured for a snap-fit to an axle, which can be installed and removed without tools.

There remains a need for novel archery bow axle connector designs that provide for smoother and quieter operation of a bow than the designs in the prior art.

U.S. Pat. Nos. 6,443,139, 6,035,840, D664,231 and U.S. Patent Application Publication No. 2010/0307471 are hereby incorporated herein in their entireties. All U.S. patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises an axle installed on a limb of the archery bow and a connector attached to the axle. The connector comprises a first body portion made from a first material and a second body portion made from a second material different from the first material. The first body portion defines an aperture therethrough arranged to engage the axle. The second body portion has a groove extending around at least a portion of its periphery. The groove comprises a first straight portion, an arcuate portion and a second straight portion as it is traversed. The first straight portion is non-parallel to the second straight portion, for example forming a taper. A cable is positioned in the groove, such as a power cable of a compound archery bow. Desirably, the first material comprises a lower coefficient of friction than the second material.

In some embodiments, the connector is formed by providing or forming the first body portion, and then forming the second body portion about the first body portion.

In some embodiments, a cable connector that is suitable for use on an axle of an archery bow comprises a first body portion and a second body portion. The first body portion is made from a first material and the second body portion is made from a second material different from the first material. The first body portion defines an aperture configured to engage an axle. The second body portion has a groove extending around at least a portion of its periphery, the groove forming a teardrop shape.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 2:
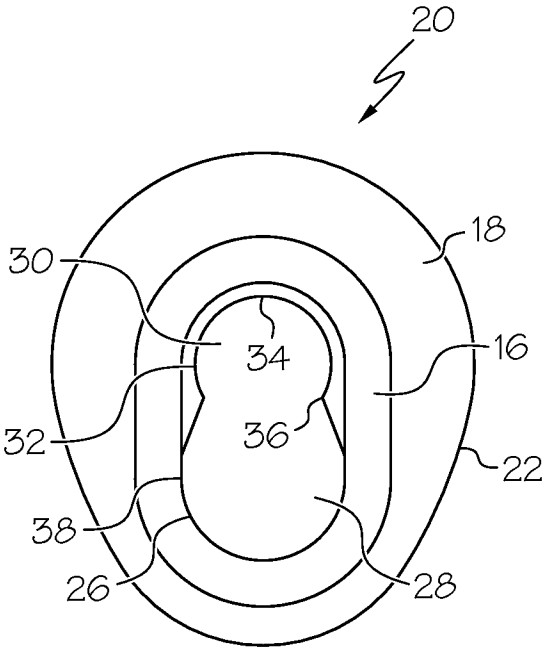
FIG. 2 shows a front view of an embodiment of an archery bow axle connector.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the Figures shall refer to like features unless otherwise indicated.

Figure 1:
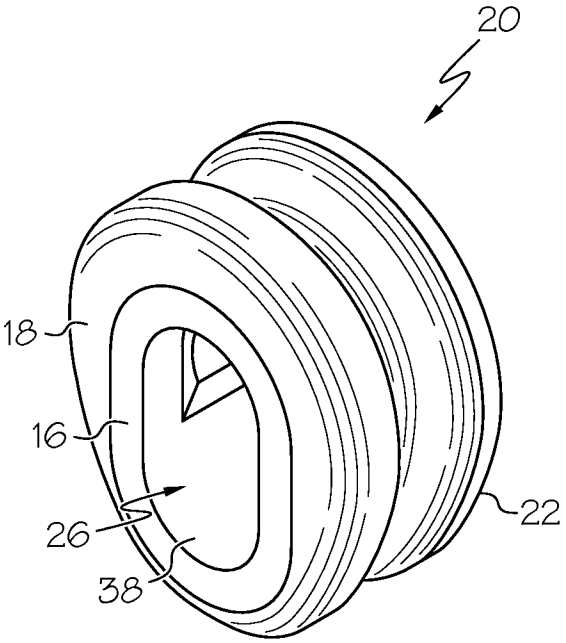
FIG. 1 shows a front quarter view of an embodiment of an archery bow axle connector.
Figure 8:
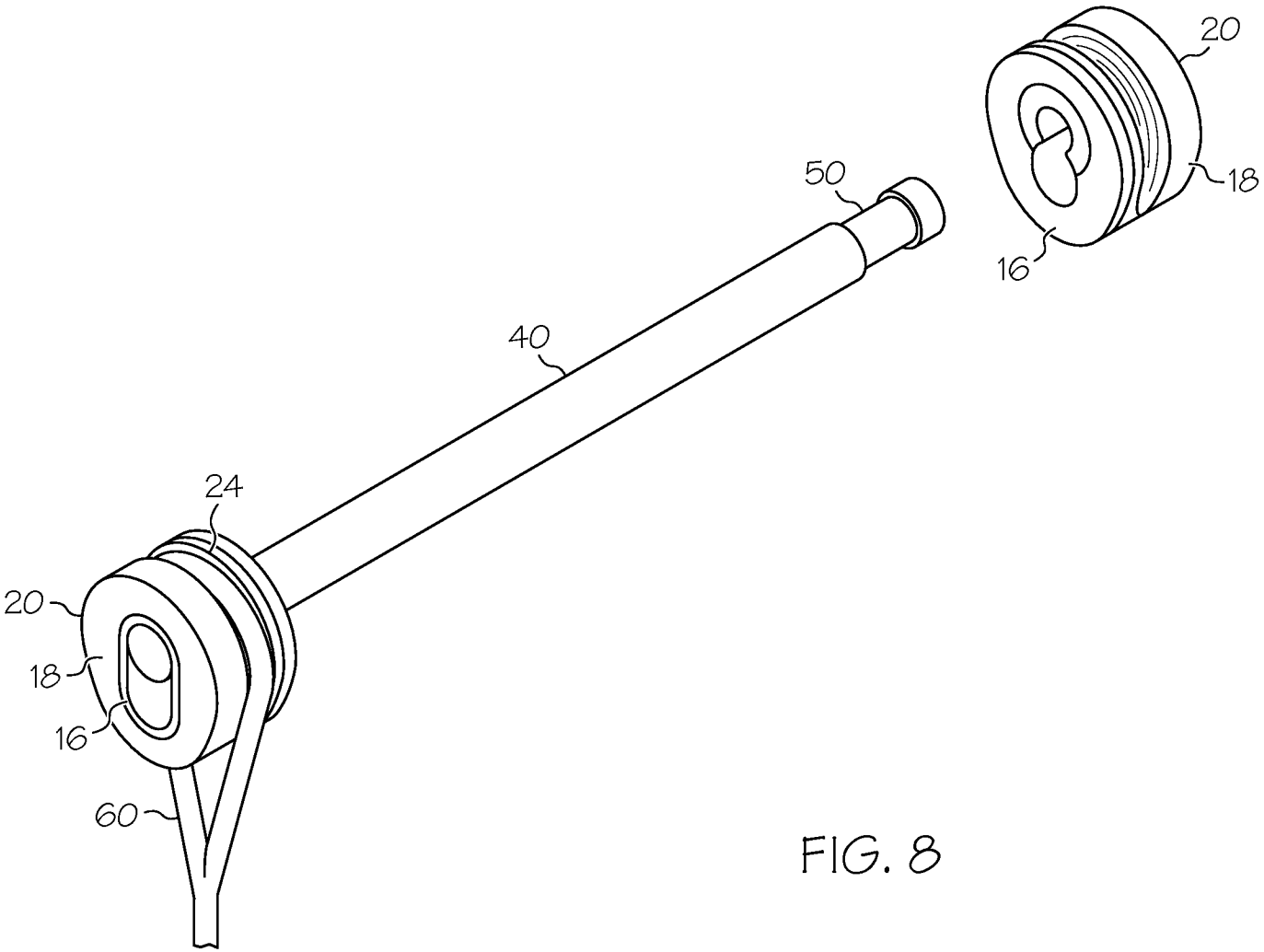
FIG. 8 shows examples of archery bow axle connectors and an archery bow axle.
Figure 9:
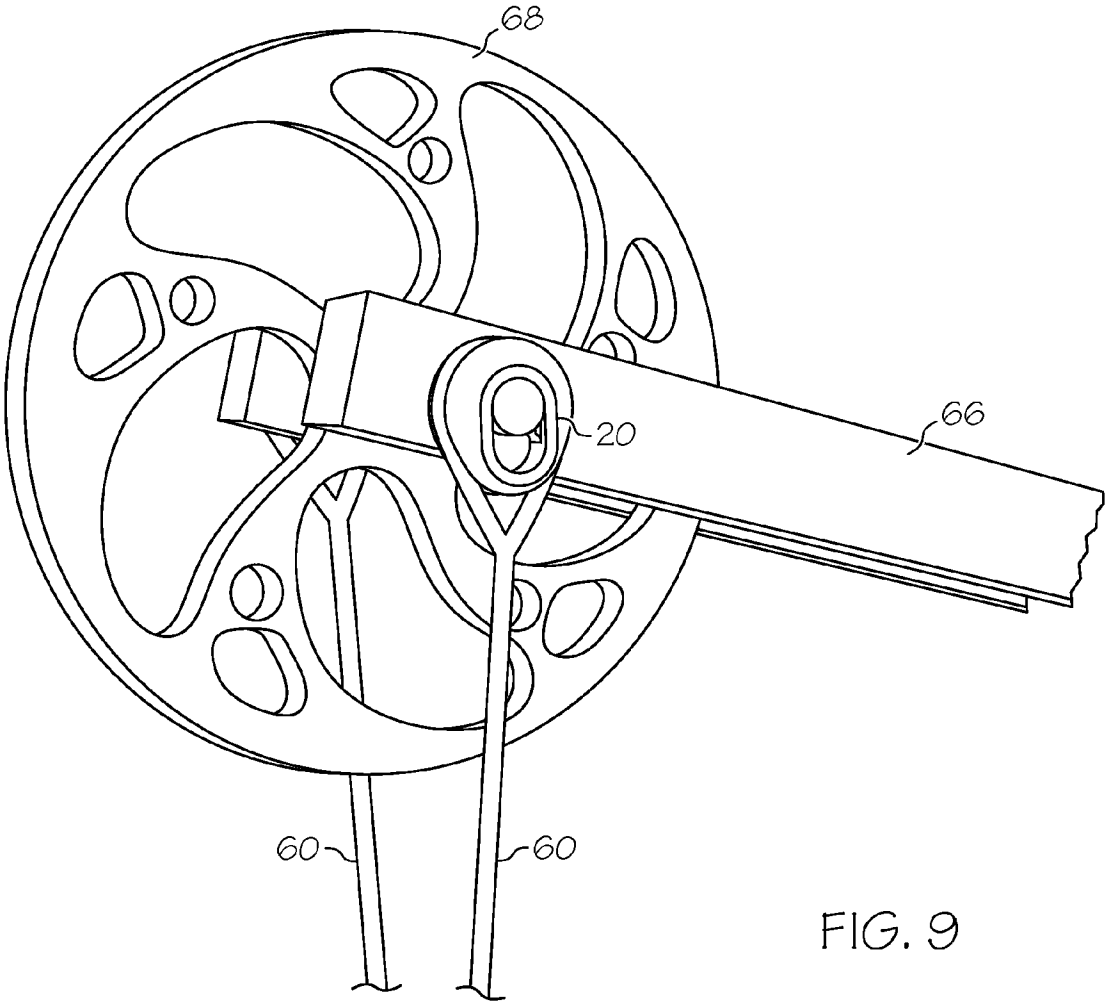
FIG. 9 shows an archery bow axle connector and an axle on a bow limb.

FIG. 1 shows an embodiment of an axle connector 20. An axle connector 20 can be used in an archery bow in conjunction with an axle 40, for example as shown in FIGS. 8 and 9. The axle connector 20 can also be considered a cable connector and/or a cable terminal.

Figure 4:
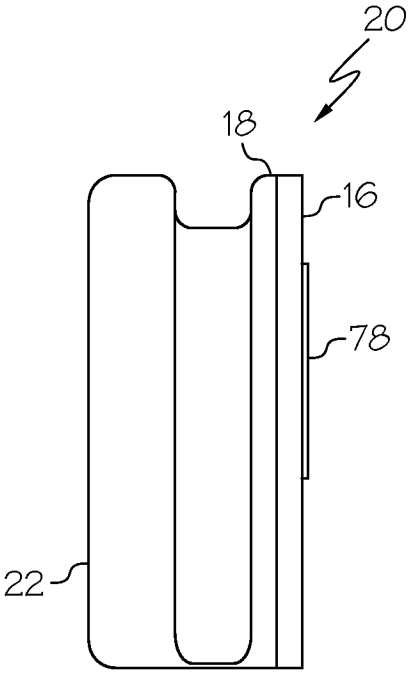
FIG. 4 shows a side view of an embodiment of an archery bow axle connector.
Figure 3:
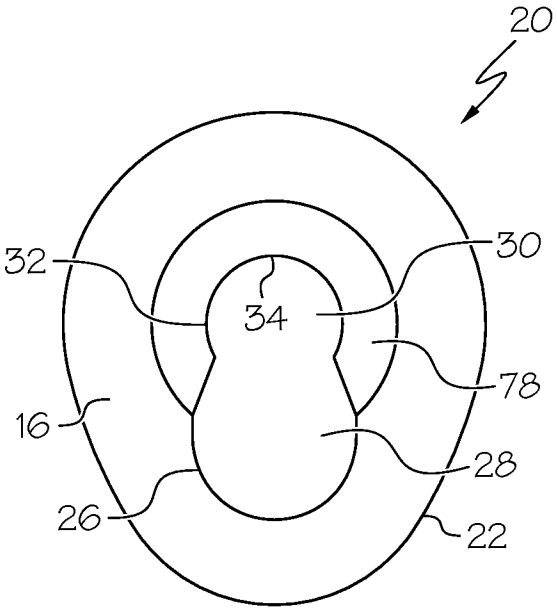
FIG. 3 shows a back view of an embodiment of an archery bow axle connector.

FIG. 2 shows a front view of an embodiment of an axle connector 20, FIG. 3 shows a back view and FIG. 4 shows a side view.

Referring to FIGS. 1-4, in some embodiments, an axle connector 20 comprises a shaped body 22. The body 22 comprises an aperture 26 that is suitably shaped to engage an axle 40 (see e.g. FIG. 8). An aperture 26 can pass through the body 22 completely. In some other embodiments, a cavity can be provided in the body 22 which does not extend through the body 22 completely.

In some embodiments, the body 22 comprises a first body portion 16 and a second body portion 18. In some embodiments, the first body portion 16 comprises a different material from the second body portion 18. In some embodiments, the first body portion 16 comprises a softer material than the second body portion 18.

In some embodiments, the first body portion 16 is arranged to contact an axle 40 and/or a limb 66 (see e.g. FIGS. 8 and 9) of a bow and the second body portion 18 is arranged to contact a cable 60 (see e.g. FIGS. 8 and 9) of a bow. In such an arrangement, when the cable 60 shifts with respect to the axle 40 or limb 66, for example as the bow is drawn, the axle connector 20 will tend to move with the cable 60. Thus, the axle connector 20 can move with respect to the axle 40 and/or a limb 66. Such movement can be stepped or choppy because the engagement between the axle connector 20 and the axle 40 and/or limb 66 tends to resist movement up to a certain level, then allow slip—for example, frictional engagement between the axle connector 20 and axle 40 can resist some level of force, but as the force increases, it overcomes the frictional engagement and results in movement. As a bow is drawn, the choppy slipping movements can occur periodically over the course of the draw cycle. The slipping movements can be audible and can result in vibrations felt by an archer, detracting from the archery experience.

The material of the axle connector 20 that contacts the axle 40 is desirably selected to minimize friction and wear. Thus, in some embodiments, the first body portion 16 comprises a low friction material, such as polyoxymethylene (POM), polytetrafluoroethylene (PTFE) and the like. In some embodiments, the first body portion 16 comprises a polymer having embedded lubrication, such as a polymer comprising silicone oil or another lubricant. In some embodiments, the first body portion 16 comprises Delrin® acetal resin available from E. I. du Pont de Nemours and Company, which may include lubricants such as silicone oil, other chemical lubricants and/or proprietary lubricants.

In In some embodiments, the second body portion 18 comprises a material selected for strength, such as reinforced plastic such as glass-filled nylon.

Figure 5:
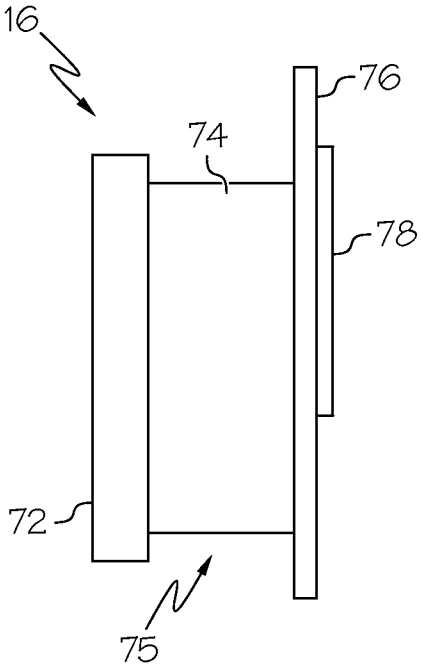
FIG. 5 shows an embodiment of a first body portion of an embodiment of an archery bow axle connector.

FIG. 5 shows a side view of an embodiment of a first body portion 16. In some embodiments, the first body portion 16 comprises a front hub 72, a central portion 74 and a back plate 76. Forming the back plate 76 from the material of the first body portion 16 will desirably reduce any frictional engagement between the axle connector 20 and the limb 66.

In some embodiments, the back of the axle connector 20 comprises a raised portion or flange 78. The flange 78 is desirably arranged to contact the limb 66. The flange 78 desirably reduces an area of contact between the axle connector 20 and the limb 66, and reduces their frictional engagement.

The first body portion 16 can be formed using any suitable method, such as machining a base material or a molding process such as injection molding.

Figure 6:
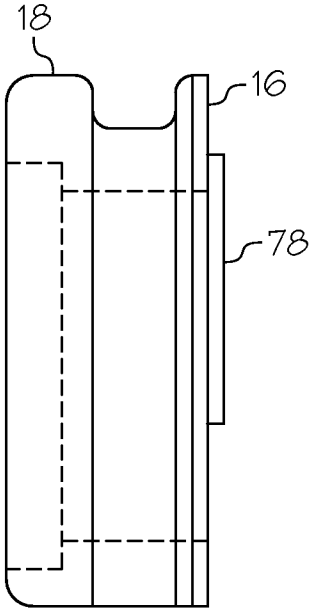
FIG. 6 shows a side view of an embodiment of an archery bow axle connector comprising a second body portion formed over a first body portion.

FIG. 6 shows an embodiment of a second body portion 18 oriented about the first body portion 16.

In some embodiments, the second body portion 18 is formed around the first body portion 16 using any suitable method. In some embodiments, multiple separate portions of the second body portion 18 are positioned around first body portion 16 and fixed to one another, for example with an adhesive. In some embodiments, a first body portion 16 can be placed into a mold, and the second body portion 18 can be overmolded about the first body portion 16.

In some embodiments, an outer surface of the first body portion 16 defines a cavity 75. For example, FIG. 5 shows a cavity 75 formed between the front hub 72 and back plate 76. Desirably, the cavity 75 extends around at least a portion of the periphery of the central portion 74. In some embodiments, the cavity 75 fully surrounds the periphery of the central portion 74. Desirably, the at least a portion of the second body portion 18 becomes oriented in the cavity 75 upon formation of the second body portion 18.

Figure 7:
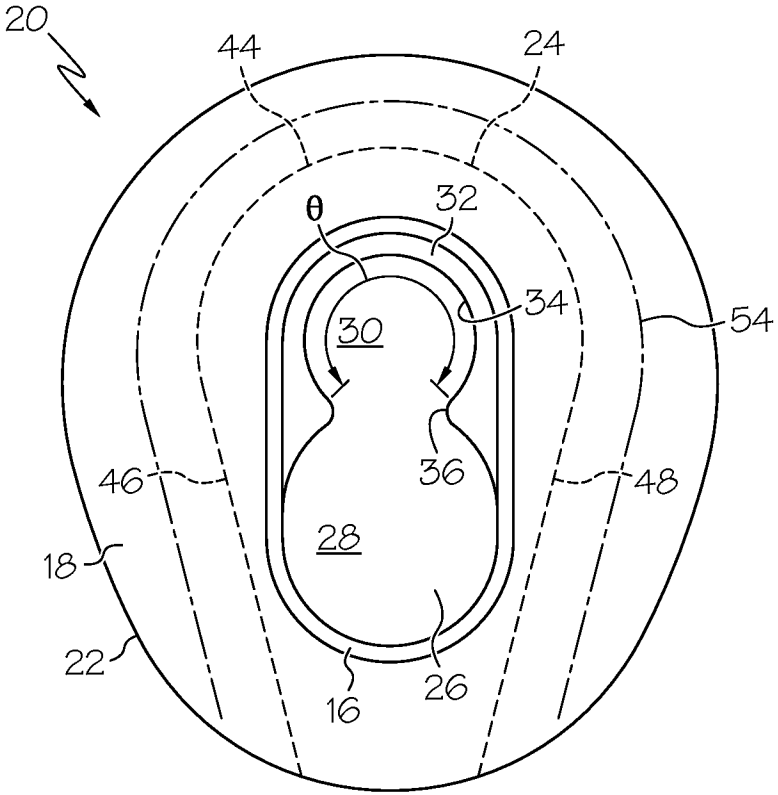
FIG. 7 shows a front view of an embodiment of an archery bow axle connector.

In some embodiments, the aperture 26 is defined by the first body portion 16 (see e.g. FIGS. 2 and 7). In some embodiments, the aperture 26 comprises a first cavity portion 28 and a second cavity portion 30. The first cavity portion 28 is typically larger than the second cavity portion 30, and the second cavity portion 30 is configured to engage an axle 40. For example, the second cavity portion 30 can be sized to engage a suitable axle with a snap fit. In some embodiments, the second cavity portion 30 and axle are sized to achieve an interference fit. In some embodiments, an axle 40 can fit easily into the first cavity portion 28, for example having a smaller size than the first cavity portion 28, and the axle 40 can be snapped into the second cavity portion 30. Thus, the axle 40 and connector 20 are moveable with respect to one another between attached configuration and detached configurations. The axle 40 is positioned in the second cavity portion 30 of the aperture 26 in the attached configuration.

In some embodiments, a sidewall 38 of the aperture 26 comprises a raised flange 32. At least a portion of the second cavity portion 30 is defined by the raised flange 32. The raised flange 32 comprises an engaging surface 34 for engaging an axle. In some embodiments, the engaging surface 34 is semicircular. In some embodiments, the engaging surface 34 contacts an axle 40 and forms an arc of contact. The arc of contact defines a central angle θ (see FIG. 7), and the central angle θ is desirably greater than 180 degrees. In some embodiments, the central angle θ can range from over 180 degrees to 300 or more degrees. In some embodiments, the central angle θ is approximately 220 degrees.

In some embodiments, the raised flange 32 comprises one or more peaks 36, which help to achieve a reliable snap fit between the axle connector 20 and the axle 40. In some embodiments, the two peaks 36 are separated by a distance, and the distance is smaller than a diameter/size of the axle 40 that passes through the peaks 36 and is engaged by the flange 32.

In some embodiments, the first cavity portion 28 and second cavity portion 30 collectively form a figure-eight shape. In some embodiments, a distance across the first cavity portion 28 is greater than a distance across the second cavity portion 30.

In some embodiments, an axle connector 20 comprises a groove 24 that extends around at least a portion of its periphery. A groove 24 can be used, for example, to anchor an archery bow cable to the axle connector 20. In some embodiments, the second body portion 18 defines the groove 24.

FIG. 7 shows another front view of an embodiment of an axle connector 20, and the contour of an embodiment of a groove 24.

In some embodiments, a groove 24 defines a teardrop shape. For example, the groove 24 defines a longitudinal axis 54 that extends around the axle 40. The longitudinal axis 54 of the groove 24 defines a substantially teardrop shape. In some embodiments, a groove 24 comprises a first straight portion 46, an arcuate portion 44 and a second straight portion 48 as the groove 24 is traversed along its length. The first straight portion 46 is nonparallel to the second straight portion 48, for example forming a taper that extends away from the arcuate portion 44. An end of each straight portion 46, 48 abut the respective ends of the arcuate portion 44.

In some embodiments, a depth of the groove 24 decreases along the length of a straight portion 46, 48 as the straight portion is traversed in a direction away from the arcuate portion 44.

In some embodiments, an arcuate portion 44 of the groove 24 is concentric with the second cavity portion 30 of the aperture 26 in the body 22, and/or concentric with at least a portion of the engaging surface 34.

In some embodiments, the second cavity portion 30 of the aperture 26 is located closer to the arcuate portion 44 of the groove 24 that to the first cavity portion 28 of the aperture 26. Thus, when the axle connector 20 is being mounted on an axle, the axle is first oriented in the first cavity portion 28. Forces are applied to the axle connector 20 and the axle in opposite direction, snapping the axle into the second cavity portion 30 of the aperture 26. When the second cavity portion 30 of the aperture 26 is located closer to the arcuate portion 44 of the groove 24, forces applied to the axle connector 20 by a cable oriented within the groove 24 will work to retain the axle in the second cavity portion 30 of the aperture 26. Thus, in some embodiments, a cable applies forces to the axle connector 20 in the same direction necessary to install the axle connector 20 on the axle, and in the opposite direction as would be necessary to remove the axle connector 20 from the axle. The teardrop shape insures that once a cable is attached, any pressure applied by the cable maintains alignment of the axle connector 20 with the cable yoke, and retains the axle connector 20 in the installed configuration until the cable forces are removed. The teardrop shape also conforms to the natural shape of a loop formed in the cable to anchor the cable to the axle connector 20 (see FIGS. 8 and 9).

In some embodiments, the depth of the raised flange portion 32 and a depth of the engaging surface 34 is less than the total depth of the axle connector 20 (see e.g. FIG. 1).

FIG. 8 shows an embodiment of an archery bow axle 40 configured for attachment to the axle connector 20 and two examples of an axle connector 20. A cable 60 is shown oriented in the groove 24 of one axle connector 20. The teardrop shape of the groove 24 matches the teardrop shape formed by the cable 60.

In some embodiments, an axle 40 comprises an engagement region 50. In some embodiments, the engagement region 50 is configured for an interference fit with a portion of the axle connector 20. For example, an outer surface of the engagement region 50 and the inner/engaging surface 34 of the aperture 26 are sized to achieve an interference fit.

In some embodiments, the engagement region 50 comprises a groove or recess in the axle 40. The size of the axle 40 at such a recess defines a recessed size or a recessed diameter compared to larger portions of the axle 40. In some embodiments, at least a portion of the raised flange 32 of the connector 20 becomes positioned in the recess 50 of the axle 40.

In some embodiments, a length of the engagement region 50 is similar to a depth of the raised flange portion 32 and/or engagement region 34 of the axle connector 20. Desirably, the length of the engagement region 50 and the depth of the raised flange 32 are measured in the same direction (e.g. parallel). In some embodiments, the groove creates raised flanges 52 in the axle 40, and a flange 52 can abut the raised flange 32 of the axle connector 20.

The engagement between the axle 40 and the axle connector 20 desirably prevents movement of the axle connector 20 along the length of the axle 40. The engagement between the axle 40 and the axle connector 20 desirably allows rotation of the axle connector 20 about the axle 40.

FIG. 9 shows an embodiment of an axle 40 and axle connectors 20 installed on an archery bow limb 66. The axle 40 supports a rotatable member 68, such as a cam or pulley. The axle connectors 20 engage the axle 40 and prevent the axle 40 from displacing along its longitudinal axis. The cables 60 comprise a split yoke forming a first portion and a second portion, the first portion terminates on the first connector and the second portion terminates on the second connector.

The axle connectors 20 allow assembly of the components illustrated in FIG. 9 without the use of tools. Further, the axle connectors 20 can be snapped off of the axle 40 upon the application of force in the correct direction without the use of tools, so the components can be disassembled without tools.

In some embodiments (not illustrated), an axle connector 20 comprises primarily a second body portion 18 comprising a second material as disclosed herein, and the first material (e.g. low friction material) comprises a coating on a surface that contacts a non-cable portion of the bow. Thus, in some embodiments, the raised flange 32 within the aperture 28 comprises the second material and has a contacting surface 34 comprising or coated with the first material, such as POM, PTFE, Delrin® acetal resin, etc. In some embodiments, the back surface of the axle connector 20 is coated with the first material.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

an axle installed on a limb of the archery bow;

a connector attached to the axle, the connector comprising a first body portion made from a first material and a second body portion made from a second material different from said first material, said first body portion defining an aperture, said second body portion having a groove extending around at least a portion of its periphery, the groove comprising a first straight portion, an arcuate portion and a second straight portion as it is traversed, the first straight portion being non-parallel to the second straight portion; and a cable positioned in the groove;

wherein an entire back surface of said connector comprises said first material.

2. The archery bow of claim 1, wherein the first material comprises a lower coefficient of friction than the second material.

3. The archery bow of claim 1, wherein the groove has a depth, the depth decreasing from a first end of the first straight portion to a second end of the first straight portion, the depth decreasing from a first end of the second straight portion to a second end of the second straight portion.

4. The archery bow of claim 1, wherein the aperture is configured to achieve a snap fit with the axle.

5. The archery bow of claim 1, wherein the groove defines a longitudinal axis, the longitudinal axis forming a teardrop shape.

6. The archery bow of claim 1, wherein the aperture comprises a first portion and a second portion, the first portion being larger than the second portion.

7. The archery bow of claim 6, the axle having an outer diameter, wherein the first portion of the aperture is larger than the outer diameter.

8. The archery bow of claim 7, wherein the second portion of the aperture is smaller than the outer diameter.

9. The archery bow of claim 7, wherein the axle comprises a recessed portion having an outer surface, the outer surface contacting an inner surface of said second portion, an arc of contact between the outer surface and the inner surface defining a central angle, the central angle being greater than 180 degrees.

10. The archery bow of claim 9, wherein the outer surface and inner surface are sized to achieve an interference fit.

11. The archery bow of claim 6, wherein the axle and the connector are moveable with respect to one another between an attached configuration and a detached configuration, the axle positioned in the second portion of the aperture in the attached configuration.

12. The archery bow of claim 6, wherein the second portion of the aperture is defined by a raised flange.

13. The archery bow of claim 12, wherein the axle further comprises a recess, the raised flange extending into said recess.

14. The archery bow of claim 13, wherein recess has a length, the flange has a depth, said length and said depth measured in the same direction, the length of the recess being approximately equal to the depth of the flange.

15. The archery bow of claim 1, wherein the first body portion comprises the back surface of the connector.

16. The archery bow of claim 1, wherein the back surface of said connector comprises a raised flange.

17. The archery bow of claim 1, said connector having been formed by providing said first body portion and forming said second body portion around said first body portion.

18. A cable connector for use on an axle of an archery bow, the cable connector comprising:

a first body portion made from a first material and a second body portion made from a second material different from said first material, said first body portion defining an aperture, said second body portion having a groove extending around at least a portion of its periphery, the groove forming a teardrop shape;

wherein an entire back surface of said cable connector comprises said first material.

19. The cable connector of claim 18, wherein said first body portion comprises a front hub and a back plate defining a cavity therebetween, and a portion of said second body portion is oriented in said cavity.

20. The cable connector of claim 18, wherein the aperture defines a figure-eight shape having first and second portions, the second portion smaller than the first portion, the second portion configured to engage said axle.

* * * * *